United States Patent [19]

Fujii

[11] Patent Number: 5,011,314

[45] Date of Patent: Apr. 30, 1991

[54] PAPER FEEDING DEVICE

[75] Inventor: Shinichiro Fujii, Shizuoka, Japan

[73] Assignee: Tokyo Electric Co., Ltd., Tokyo, Japan

[21] Appl. No.: 522,086

[22] Filed: May 14, 1990

Related U.S. Application Data

[63] Continuation of Ser. No. 263,868, Oct. 28, 1988, abandoned.

[30] Foreign Application Priority Data

Oct. 30, 1987 [JP] Japan ..... 62-166447[U]

[51] Int. Cl.[5] ..... B41J 15/08

[52] U.S. Cl. ..... 400/619; 400/642; 400/647

[58] Field of Search ..... 400/616, 616.2, 637.2, 400/642, 647, 619

[56] References Cited

U.S. PATENT DOCUMENTS

| | | | |
|---|---|---|---|
| 752,092 | 2/1904 | Myers | 400/637.2 |
| 1,058,672 | 4/1913 | Helmond | 400/637.2 |
| 1,596,467 | 8/1926 | Waldheim | 400/637.2 X |
| 2,005,450 | 6/1935 | Bower | 400/647 X |
| 2,297,490 | 9/1942 | Martin | 400/647 X |
| 2,582,783 | 1/1952 | Kloski | 400/647 X |
| 4,197,023 | 4/1980 | DeBoo | 400/642 X |
| 4,606,663 | 7/1986 | Christoph | 400/616 |
| 4,806,035 | 2/1989 | Maeda | 400/642 |

FOREIGN PATENT DOCUMENTS

| | | | |
|---|---|---|---|
| 0209166 | 11/1984 | Japan | 400/616 |
| 60-52376 | 3/1985 | Japan | 400/642 |
| 60-52377 | 3/1985 | Japan | 400/642 |
| 0161173 | 8/1985 | Japan | 400/616 |
| 60-161173 | 8/1985 | Japan | 400/642 |
| 245573 | 12/1985 | Japan | 400/647 |
| 0051369 | 3/1986 | Japan | 400/616 |
| 134280 | 6/1987 | Japan | 400/616.2 |
| 2125339 | 3/1984 | United Kingdom | 400/616 |

*Primary Examiner*—Edgar S. Burr
*Assistant Examiner*—John S. Hilten
*Attorney, Agent, or Firm*—Oblon, Spivak, McClelland, Maier & Neustadt

[57] ABSTRACT

A paper feeding device comprises a tractor including a paper transport member having a circumferential speed set substantially equal to or a little lower than the circumferential speed of a platen, a fulcrum shaft supporting the tractor thereon for pivotal motion between a pushing in position in which the tractor is directed toward a lower portion of an outer periphery of the platen and a pulling position in which the tractor is directed to an upper portion of the outer periphery of the platen, and a thin piece extending along the lower portion of the outer periphery of the platen from an extension line of a paper feeding route of the tractor in the pushing in position between the platen and the tractor and resiliently contacting with an inner face of a paper pan. When the tractor is fixed to the pushing in position, paper supplied from the tractor is guided by the thin piece and will not hang down to the paper pan side. To the contrary, when the tractor is fixed to the pulling position, paper is supplied from between the thin piece and the paper pan so that it is displaced away from the platen and is not acted upon by driving force of the platen, thereby preventing possible occurrence of slackening of the paper between the upper portion of the platen and the tractor.

2 Claims, 2 Drawing Sheets

PAPER FEEDING DEVICE

This application is a Continuation of application Ser. No. 263,868, filed on Oct. 28, 1988, now abandoned.

FIELD OF THE INVENTION AND RELATED ART STATEMENT

This invention relates to a paper feeding device for use with a printer, and more particularly to a paper feeding device which includes a platen and a tractor having a paper transporting function and wherein the tractor can be used in two transporting modes including a paper pushing in mode in which it pushes paper in to the platen and a paper pulling out mode in which it pulls paper out from the platen.

An exemplary one of conventional paper feeding devices of the type mentioned just above is shown in FIGS. 3 and 4. Referring to FIGS. 3 and 4, a platen 1 is connected to be driven by a motor not shown, and a paper bail roller 2 is mounted above the platen 1 for movement into and out of contact with the platen 1 while a pair of pinch rollers 4 are mounted below the platen 1 for movement into and out of contact with the platen 1 and a paper pan 3. A pair of tractors 6 are supported for sliding movement and also for pivotal motion on fulcrum shafts 5 mounted on a pair of left and right side walls not shown on which the platen 1 is mounted for rotation. Each of the tractors 6 is composed of a holder 7, a driving wheel 9 supported on the holder 7 such that it may be driven by a drive shaft 8, a belt not shown which has a plurality of projections on an outer periphery thereof and serves as a paper transport member adapted to receive a turning force of the driving wheel 9, and a paper holding down member 10 for holding down paper 11 which has a large number of perforations formed along opposite side edges thereof and adapted to be engaged by the projections on the belts of the tractors 6. The drive shaft 8 is received at the opposite ends thereof in a pair of arcuate holes formed in the opposite side walls and extending in an arc centered at the center of the fulcrum shafts 5, thereby defining the range of pivotal motion of the tractors 6 around the center of the fulcrum shafts 5. A pair of fixing means 12 are supported on the side walls for movement relative to the drive shaft 8. The fixing means 12 are held in resilient contact with the opposite end portions of the drive shaft 8 for alternatively fixing the tractors 6 to a pushing in position shown in FIG. 3 or a pulling position shown in FIG. 4.

Accordingly, when the paper feeding device is in the condition shown in FIG. 3 wherein the tractors 6 are fixed in the pushing in position, paper 11 is supplied from the tractors 6 to a lower portion of an outer periphery of the platen 1. In this instance, the circumferential speed of the belts of the tractors 6 is commonly set to a speed a little lower than the circumferential speed of the platen 1. Accordingly, the platen 1 pulls the paper 11 so that possible slackening of the paper 11 between the platen 1 and the tractor 6 is prevented. Since thereupon the platen 1 rotates ahead slipping on the paper 11, there is no trouble which may otherwise arise from a difference in circumferential speed between the platen 1 and the belts of the tractors 6.

However, since the distance between the platen 1 and a rear portion of the paper pan 3 is considerably large, before a leading end of the paper 11 reaches the lower portion of the outer periphery of the platen 1 in the pushing in position of the tractors 6, the end of the paper 11 will hang down and be slackened as seen in FIG. 3, which will cause paper jamming. On the other hand, when the paper feeding device is in the condition shown in FIG. 4 wherein the tractors 6 are fixed in the pulling position, the paper 11 sent out from an upper portion of the platen 1 is pulled by the tractors 6. However, since the circumferential speed of the belts of the tractors 6 is lower than the circumferential speed of the platen 1, the paper 11 will be slackened between the upper portion of the outer periphery of the platen 1 and the tractors 6. Such slackening will be accumulated and cause paper jamming.

To the contrary, if the circumferential speed of the belts of the tractors 6 is set a little higher than the circumferential speed of the platen 1 when the tractors 6 are in the pulling position in order to eliminate such a phenomenon as described above, slackening of the paper 11 will be prevented. However, since the paper 11 is pulled between the platen 1 and the tractors 6, there is a problem that the paper 11 may be broken at portions around the perforations on the opposite side edges thereof.

Additionally, since the platen 1 is formed from a soft material, the change in outer diameter due to a difference in temperature is great, which will cause a change in circumferential speed. In order to decide the tendency of the change, the circumferential speed of the belts of the tractors 6 is normally set a little lower than the circumferential speed of the platen.

OBJECTS AND SUMMARY OF THE INVENTION

It is a first object of the present invention to provide a paper feeding device which prevents jamming of paper therein.

It is a second object of the present invention to provide a paper feeding device which prevents paper from being slackened between a platen and a tractor when the tractor is in its paper pushing in position.

It is a third object of the present invention to provide a paper feeding device which prevents paper from being slackened between a platen and a tractor when the tractor is in its paper pulling position.

According to the present invention, a paper feeding device comprises a tractor including a paper transport member having a circumferential speed set substantially equal to or a little lower than the circumferential speed of a platen, a fulcrum shaft supporting the tractor thereon for pivotal motion between a pushing in position in which the tractor is directed toward a lower portion of an outer periphery of the platen and a pulling position in which the tractor is directed to an upper portion of the outer periphery of the platen, and a thin piece extending along the lower portion of the outer periphery of the platen from an extension line of a paper feeding route of the tractor in the pushing in position between the platen and the tractor and resiliently contacting with an inner face of a paper pan. Thus, when the paper feeding device is in a condition wherein the tractor is fixed to the pushing in position, paper supplied from the tractor is introduced to the lower portion of the outer periphery of the platen under the guidance of the thin piece and will not hang down to the paper pan side. Further, since the circumferential speed of the paper transport member of the tractor is substantially equal to or a little lower than the circumferential speed of the platen, occurence of paper jamming between the lower portion of the outer periphery of the platen and the tractor is prevented. On the otherhand, when the paper feeding device is in another condition wherein the tractor is fixed to the pulling position, paper is supplied from the thin piece and the paper pan whereupon the thin piece presses against an inner face of the paper pan so as to displace the paper away from the platen thereby to apply tensile force to the paper. Further, the area over which the paper and the platen are contacted with each other is reduced so that also the paper pulling force of the platen is reduced. Accordingly, even if the circumferential speed of the paper transport member of the tractor is a little lower than the circumferential speed of the platen, possible slackening of the paper between the upper portion of the platen and the tractor can be prevented.

DETAILED DESCRIPTION OF THE PREFERRED EMBODIMENT

Figure 3:
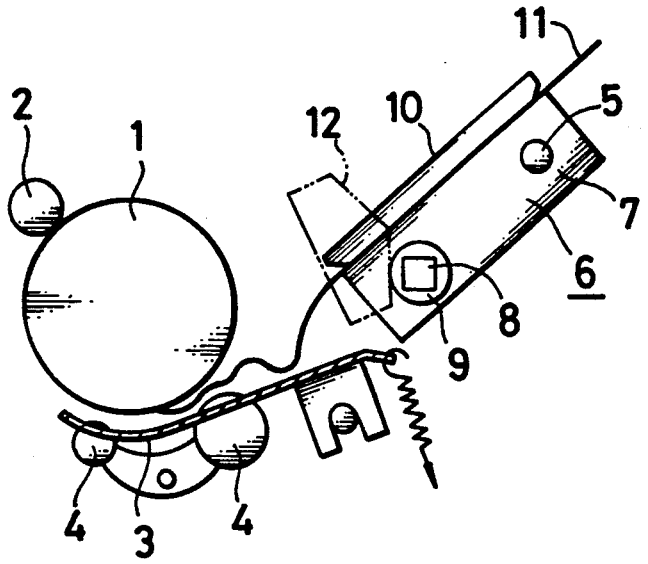
FIG. 3 (PRIOR ART)
FIG. 3 is a vertical sectional side elevational view showing an exemplary one of conventional paper feeding devices when it is used in a paper pushing in condition.
Figure 4:
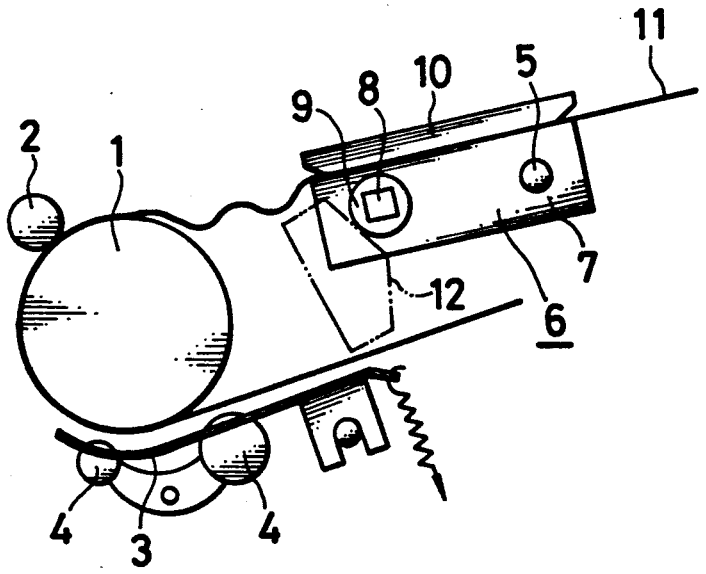
FIG. 4 (PRIOR ART)
FIG. 4 is a vertical sectional side elevational view showing the conventional paper feeding device of FIG. 3 when it is used in a paper pulling condition.

A paper feeding device according to an embodiment of the present invention will be described with reference to FIGS. 1 and 2. The paper feeding device of the embodiment shown has a similar construction to the conventional paper feeding device shown in FIGS. 3 and 4 except that it additionally includes a guide plate 13 and a thin piece 14. Accordingly, like parts are denoted by like reference numerals to those of FIGS. 3 and 4 and overlapping description thereof is omitted herein. In particular, the paper feeding device includes a guide plate 13 located on an extension plane of a paper feeding route of a tractor 6 in a pushing in position between a platen 1 and the tractor 6 (on an extension plane of a plane in which an upper face of a holder 7 and a paper holder 10 contact with each other), and a thin piece 14 extending from the guide plate 13 along a lower portion of an outer periphery of the platen 1 and resiliently contacting with an inner face of a paper pan 3.

The circumferential speed of a belt of the tractor 6 is set to a circumferential speed substantially equal to or a little lower than the circumferential speed of the platen 1.

Figure 1:
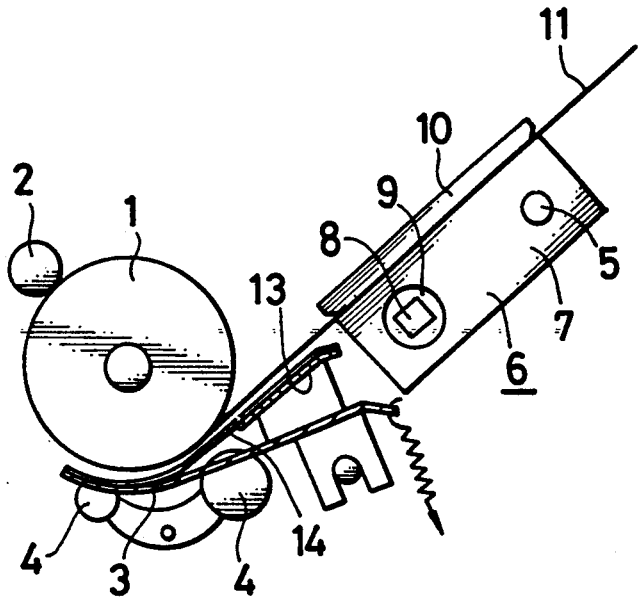
FIG. 1 is a vertical sectional side elevational view showing a paper feeding device according to an embodiment of the present invention when it is used in a paper pushing in condition.

With the paper feeding device of such a construction as described above, when it is such a condition as shown in FIG. 1 wherein the tractor 6 is fixed to the pushing in position, paper 11 supplied from the tractor 6 is introduced to the lower portion of the outer periphery of the platen 1 under the guidance of the guide plate 13 and the thin piece 14. Accordingly, the paper 11 will not hang down to the paper pan 3 side and can be introduced to the lower portion of the outer periphery of the platen 1 in a straight line. In case the circumferential speed of the platen 1 is substantially equal to the circumferential speed of the belt of the tractor 6, the paper 11 will be fed without being slackened or without being particularly strained between the platen 1 and the tractor 6. To the contrary, in case the circumferential speed of the belt of the tractor 6 is a little lower than the circumferential speed of the platen 1, the platen 1 will pull the paper 11 from the tractor 6 side due to frictional force between them. Since the platen 1 thereupon rotates ahead slipping on the paper 11, the paper 11 will not be broken. Consequently, occurrence of paper jamming between the lower portion of the outer periphery of the platen 1 and the tractor 6 is prevented.

Figure 2:
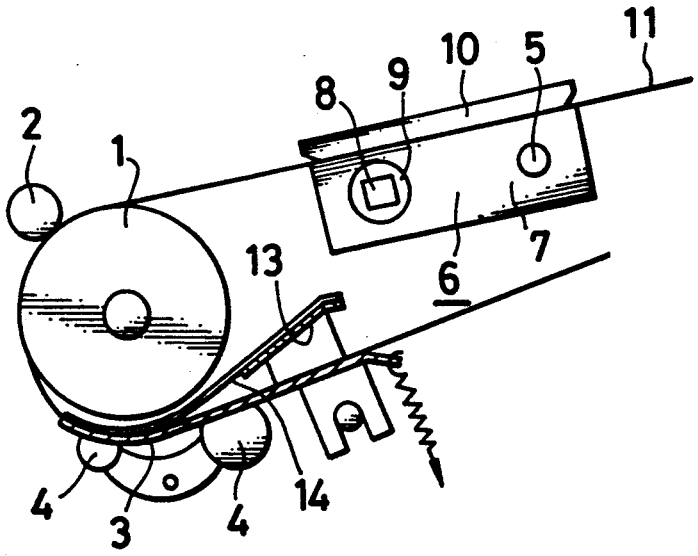
FIG. 2 is a vertical sectional side elevational view showing the paper feeding device when it is used in a paper pulling condition.

Meanwhile, when the paper feeding device is in such a condition as shown in FIG. 2 wherein the tractor 6 is fixed to the pulling position, paper 11 is supplied from between the thin piece 14 and the paper pan 3. Thereupon, the thin piece 14 presses against an inner face of the paper pan 3 so as to displace the paper 11 away from the platen 1 thereby to apply tension to the paper 11, and consequently the area over which the paper 11 and the platen 1 are contacted with each other is reduced so that also the force of the platen 1 to pull the paper 11 due to frictional force therebetween is reduced. Accordingly, even where the circumferential speed of the belt of the tractor 6 is a little lower than the circumferential speed of the platen 1, slackening of the paper 11 between the upper portion of the platen 1 and the tractor 6 can be prevented. Further, while the thin plate 14 applies tension to the paper 11, the paper 11 will not be broken at portions around the perforations on the opposite sides thereof because slipping of the paper 11 on the paper pan 3 is permitted against the paper pulling force of the tractor 6.

With the paer feeding device of the embodiment described above, when it is in a condition in which the tractor is fixed to the pushing in position, paper supplied from the tractor is introduced to the lower portion of the outer periphery of the platen under the guidance of the thin piece. Accordingly, the paper will not hang down to the paper pan side. Further, since the circumferential speed of the paper transport member of the tractor is substantially equal to or a little lower than the circumferential speed of the platen, occurrence of paper jamming between the lower portion of the outer periphery of the platen and the tractor can be prevented. To the contrary, when the paper feeding device is in another condition in which the tractor is fixed to the pulling position, paper is supplied from between the thin piece and the paper pan whereupon the thin piece presses against an inner face of the paper pan so as to displace the paper away from the platen to thereby apply tension to the paper. Further, the area over which the paper and the platen are contacted with each other is reduced so that also the paper pulling force of the platen is reduced. Accordingly, even if the circumferential speed of the paper transport member of the tractor is a little lower than the circumferential speed of the platen, slackening of the paper between the upper portion of the platen and the tractor can be prevented.

What is claimed is:

1. A paper feeding device for feeding paper, comprising:

a platen;

a paper pan extending along a lower portion of an outer periphery of said platen;

a tractor including a paper transport member having a circumferential speed set substantially equal to or a little lower than the circumferential speed of said platen;

a fulcrum shaft supporting said tractor thereon for pivotal motion between a pushing in position in which said tractor is directed toward the lower portion of the outer periphery of said platen and a pulling position in which said tractor is directed to an upper portion of the outer periphery of said platen;

a fixing means for alternatively fixing said tractor to the pushing in position or the pulling position; and a thin piece extending along the lower portion of the outer periphery of said platen from an extension line of a paper feeding route of said tractor in the pushing in position between said platen and said tractor and resiliently contacting with an inner face of said paper pan, such that when said tractor is in said pushing in position, said thin piece is for guiding said paper to said lower portion of said outer periphery of the platen, and when said tractor is in said pulling position, said paper is supplied from between said thin piece and said paper pan, and said thin piece is for applying a force to said paper to displace said paper away from the platen such that said paper and said platen do not contact each other along at least said lower portion of said outer periphery of said platen under which said paper pan and said thin piece extend to thereby reduce a paper pulling force of said platen.

2. A paper feeding device for feeding paper, comprising:

a platen;

a paper pan extending along a lower portioin of an outer periphery of said platen;

a tractor including a paper transport member having a circumferential speed set substantially equal to or a little lowe than the circumferential speed of said platen;

a fulcrum shaft supporting said tractor thereon for pivotal motion between a pushing in position in which said tractor is directed toward the lower portion of the outer periphery of said platen and a pulling position in which said tractor is directed to an upper portion of the outer periphery of said platen;

a fixing means for alternatively fixing said tractor to the pushing in position or the pulling position;

a guide plate located on an extension plane of a paper feeding route of said tractor in the pushing in position between said platen and said tractor; and a thin piece extending along the lower portion of the outer periphery of said platen from said guide plate and resiliently contacting with an inner face of said paper pan, such that when said tractor is in said pushing in position, said thin piece is for guiding said paper to said lower portion of said outer periphery of the platen, and when said tractor is in said pulling portion, said paper is supplied from between said thin piece and said paper pan, and said thin piece is for applying a force to said paper to displace said paper away from the platen such that said paper and said platen do not contact each other along at least said lower portion of said outer periphery of said platen under which said paper pan and said thin piece extend to thereby reduce a paper pulling force of said platen.

* * * * *